United States Patent [19]

Johnson

[11] Patent Number: 4,706,599

[45] Date of Patent: Nov. 17, 1987

[54] BOAT COCKPIT ENCLOSURE

[75] Inventor: David E. Johnson, Venice, Fla.

[73] Assignee: John R. Faria, Venice, Fla.

[21] Appl. No.: 21,518

[22] Filed: Feb. 26, 1987

Related U.S. Application Data

[63] Continuation of Ser. No. 850,721, Apr. 11, 1986, abandoned, which is a continuation of Ser. No. 666,998, Oct. 31, 1984, abandoned, which is a continuation-in-part of Ser. No. 427,867, Sep. 29, 1982, Pat. No. 4,492,175, which is a continuation-in-part of Ser. No. 389,712, Jun. 18, 1982, abandoned.

[51] Int. Cl.[4] ..... B63H 9/00

[52] U.S. Cl. ..... 114/361; 135/88

[58] Field of Search ..... 114/361, 39, 351; 135/88, 117; 296/159, 160, 163

[56] References Cited

U.S. PATENT DOCUMENTS

| | | | |
|---|---|---|---|
| 1,067,660 | 7/1913 | Kay | 114/361 |
| 1,636,507 | 7/1927 | Goodman | 135/117 X |
| 3,052,251 | 9/1962 | Jean, Jr. | 135/117 x |
| 3,326,597 | 6/1967 | Barker | 135/88 X |

*Primary Examiner*—Sherman D. Basinger

*Attorney, Agent, or Firm*—Gifford, Groh, VanOphem, Sheridan, Sprinkle and Dolgorukov

[57] ABSTRACT

An enclosure for an open area or an open cockpit in a watercraft, the open area or cockpit having an elevated covering disposed over the open area or open cockpit. The enclosure is a single length of flexible canvas, screening or transparent plastic material having an upper edge removably secured to the covering and draped downward from the covering, the enclosure having a lower edge wrapped around a weighting member for engaging the enclosure lower edge in contact with a surface of the watercraft.

12 Claims, 11 Drawing Figures

BOAT COCKPIT ENCLOSURE

CROSS-REFERENCE TO RELATED APPLICATIONS

This is a continuation of co-pending application Ser. No. 850,721 filed on Apr. 11, 1986, now abandoned, which is a continuation of application Ser. No. 666,998, filed Oct. 31, 1984, now abandoned, which was a continuation-in-part of application Ser. No. 427,867, filed Sept. 29, 1982, now U.S. Pat. No. 4,492,175, issued Jan. 8, 1985, which was a continuation-in-part of application Ser. No. 389,712, filed June 18, 1982, now abandoned.

BACKGROUND OF THE INVENTION

The present invention relates to a removable enclosure for a watercraft cockpit, such as a sailboat or motorboat cockpit, and for a watercraft open area protected by an elevated covering, top or roof.

Open watercraft, motorboats for example, are often provided with a permanent or foldable top, such as a "Bimini" top, affording the passengers and crew some protection against sun rays or rain. Such tops are often made of canvas supported by an appropriate foldable tubular frame, or they may be of the hard-top type, namely made of wood, plastic or light metal, supported by permanent posts.

Sailboats may also be provided with tent-like tops, of the "Bimini" type for example or, as disclosed in copending application Ser. No. 427,867, now U.S. Pat. No. 4,492,175, they may be provided with a boom tent supported by elongate members attached at one end to the boom and extending outwardly on the port and starboard side from the boom.

SUMMARY OF THE INVENTION

The present invention provides an enclosure for removable attachment to a top, more particularly a watercraft top, which can be made of canvas, screening material or transparent plastic film, which may be easily attached to the top and which is simply draped downwardly from the top and requires no fastening means for attachment to the watercraft deck. When not in use, the enclosure may be quickly removed and rolled in a small package which is easily stored away.

A better understanding of the invention will be obtained by those skilled in the art when the following description of the best modes contemplated for practicing the invention is read in conjunction with the accompanying drawings in which:

DETAILED DESCRIPTION OF THE PREFERRED EMBODIMENT

Figure 1:
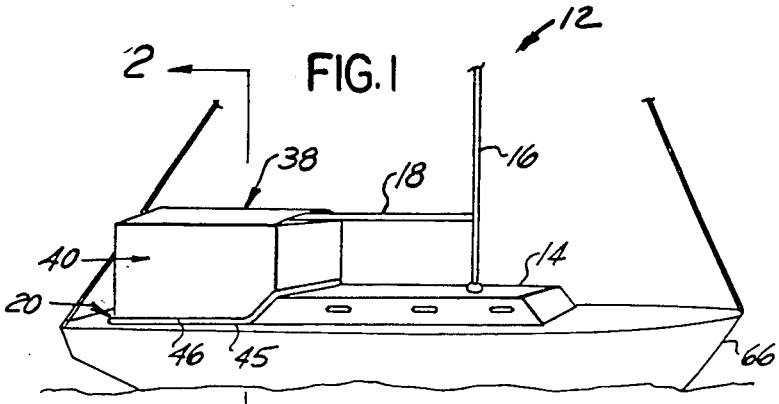
FIG. 1 is a schematic perspective view of a sailboat provided with a cockpit enclosure according to the present invention.
Figure 2:
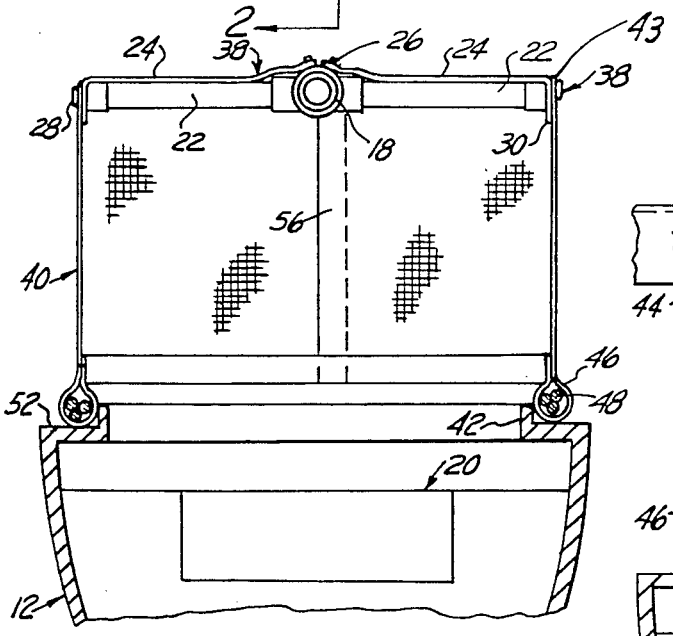
FIG. 2 is a section along line 2—2 of FIG. 1.
Figure 4:
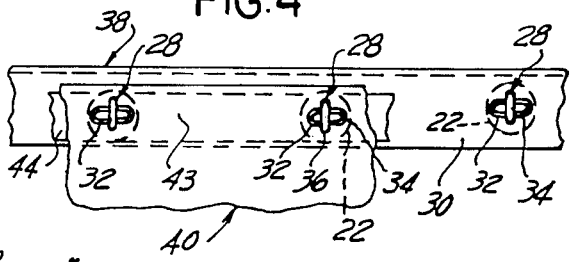
FIG. 4 is a partial side elevational view thereof.

Referring to the drawings and more particularly to FIGS. 1 and 2 thereof, there is illustrated a sailboat 12 having a cabin structure 14 and a mast 16. A boom 18 is pivotally attached to the mast 16, in a conventional manner and extends aft of the mast 16 partly over a cockpit 20, best seen at FIG. 2. As disclosed in detail in copending application Ser. No. 427,867, now U.S. Pat. No. 4,492,175, a plurality of elongate support members 22 are mounted at regular intervals on each side of the boom 18 extending on the port and starboard sides from the boom 18. A length 24 of canvas is attached on the top of the elongate support members 22 on one side of the boom 18 and a similar length 24 of canvas is attached over the elongate support members 22 on the other side of the boom 18, the lengths 24 of canvas being removably attached by any convenient fastening means such as snaps or thumb twist fasteners. For the sake of illustration, the lengths 24 of canvas are illustrated at FIG. 2 as being fastened by snaps 26 alongside the boom 18 and by thumb twist fasteners 28 proximate the edge draped over the end of the elongate support members 22, such as to form a substantially vertically extending flap 30. The flat 30 has a plurality of elongate slots 32, FIG. 4, bordered by a metallic frame 34 for passing over the rotational head 36 of the thumb twist fasteners 28, after which the thumb twist fastener head 36 is rotated, to the position shown at FIG. 4, for holding the edge of the lengths 24 of canvas in position such as to form a tent top 38 over the cockpit 20.

An enclosure 40 is draped around the cockpit 20 and extends from the tent top 38 to the gunwale 42. The enclosure 40 is made of any appropriate thin flexible material such as light canvas, flexible woven mesh screening as shown, or transparent plastic film. Preferably it is made of a single length of material and is provided at its upper edge 43, FIG. 4, with a fabric tape 44, sewn or adhered thereto, for edge reinforcement. The reinforcement upper edge 43 of the material of the enclosure 40 is provided with framed elongate slots 32 for attachment by means of the same thumb twist fastener 28 used for attaching the flap 30 of the boom tent 38 to the end of the elongate support members 22.

Figure 3:
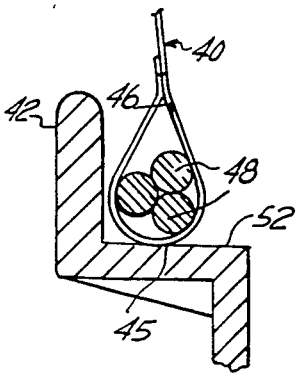
FIG. 3 is an enlarged view of a portion of the structure illustrated at FIG. 2.
Figure 5:
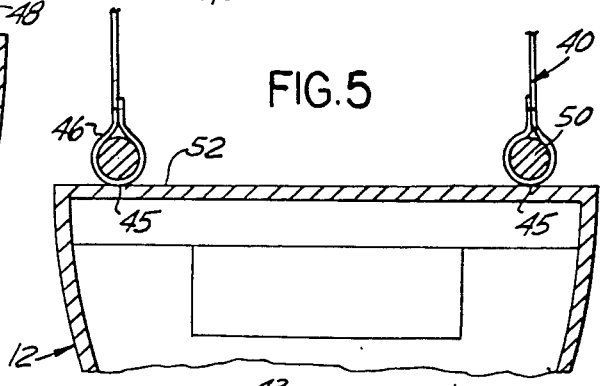
FIG. 5 is a partial schematic view showing one of the advantages of the invention.

The lower edge 45 of the enclosure 40 is formed as a gusset-like hem 46, FIGS. 2 and 3, which encloses an elongate mass of weighting material. The weighting material may consist of short lengths of chain, bars of metal or plastic. Preferably, the weighting material consists of several continuous lengths of relatively light rope 48, FIGS. 2 and 3, or of a single continuous length of heavy rope 50, FIG. 5. The heavily loaded lower edge 45 of the enclosure 40 simply rests on the boat deck 52, FIGS. 2 and 5, on any horizontal or inclined deck surface, simply by gravity without the requirement of fasteners being used for attaching the lower edge 45 of the enclosure 40 to a surface or to the gunwale 42 of the cockpit 20, FIG. 2.

Figure 6:
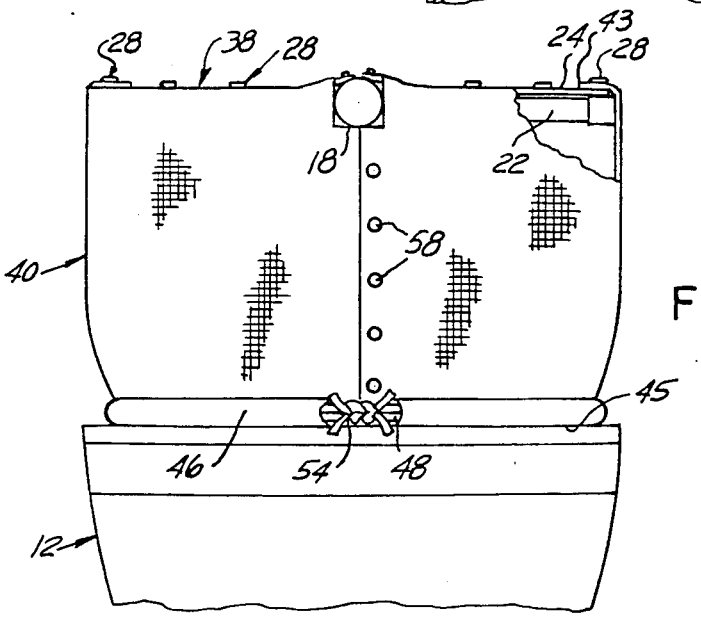
FIG. 6 is a partial view of a sailboat stern illustrating a modification of the invention.

Preferably, the lower weighted edge 45 of the enclosure 40, in structures where the cockpit 20 is provided with a gunwale 42, FIGS. 2 and 3, is also generally engaged with the outer surface of the gunwale 42 which permits a snug fitting, if so desired and as illustrated at FIG. 6, by allowing both ends of the length of rope 50, or both ends of one of the multiple lengths of rope 48, as illustrated, to project through the end of the gusset-like hem 46 to be tied together in a knot 54. The two lateral edges of the enclosure 40 may be simply left to overlap one another as shown at 56 at FIG. 2, or they may be united by snap fasteners 58 where they overlap, as shown at FIG. 6. FIG. 6 also illustrates a modification wherein the upper edge 43 of the enclosure 40 is folded over the tent top 38 and is attached by means of thumb twist fasteners 28 to the top of the elongate support members 22 rather than on the end of the elongate support members 22.

Figure 7:
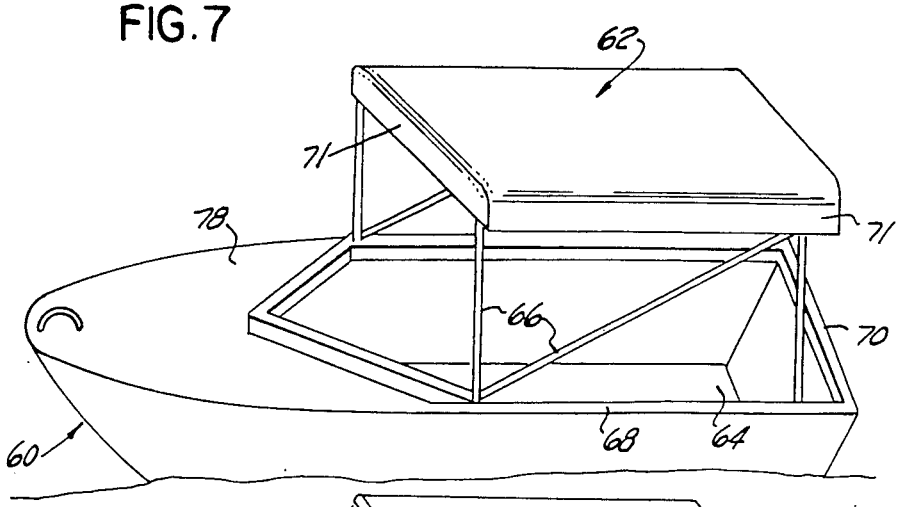
FIG. 7 is a schematic view of a motorboat provided with a "Bimini"-type top.
Figure 8:
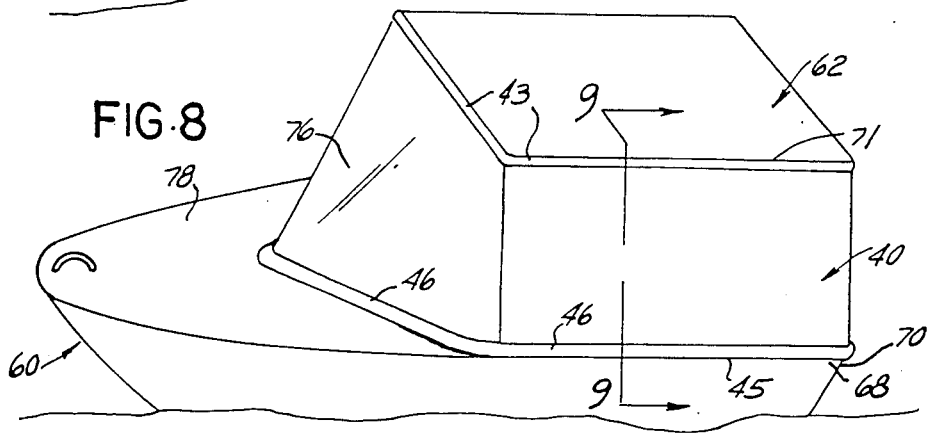
FIG. 8 is a view similar to FIG. 7 but showing the motorboat provided with a cockpit enclosure according to the present invention.
Figure 9:
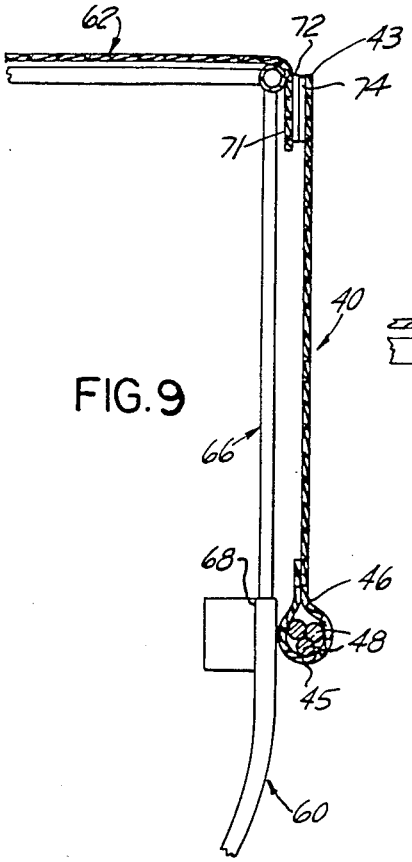
FIG. 9 is a partial section along line 9—9 of FIG. 8.

FIG. 7 illustrates a motorboat 60 provided with a "Bimini"-type top 62 supported over a cockpit 64 by a tubular frame superstructure 66. An enclosure 40 according to the present invention is illustrated at FIG. 8 extending from the "Bimini" top 62 to the gunwales 68 on both sides of the boat 60 and over the stern 70. In structures wherein the top 62 is made of canvas or is a hardtop, a convenient means for attaching the upper edge 43 of the enclosure 40 to the edge 71 of the top 62 comprises a pair of complementary Velcro-type material 72 and 74, one band of Velcro-type material 72 being attached to the edge 71 of the top 62 and the complementary band 74 being attached proximate the upper edge 43 of the enclosure 40, FIG. 9. The band 72 of Velcro-type material may be attached to the outside of the top edge 71 as shown at FIG. 9 or it may be attached to the interior. In such a structure as shown at FIGS. 8–9, the lower edge 45 of the enclosure 40 is also provided with a gusset-like hem 46 in which is placed a heavy rope or a plurality of lighter ropes 48 which are holding the enclosure 40 taut, by gravity, with the lower edge 45 of the enclosure 40 preferably in engagement with a deck surface of the boat 60 or with a side surface of the hull, as illustrated, proximate the gunwale 68. The front panel 76 of the enclosure 40, FIG. 8, provided with a gusset-like hem 46 in which is disposed a heavy rope or a plurality of lighter ropes 48, is also engaged by gravity with a surface of the boat forward deck 78.

Figure 10:
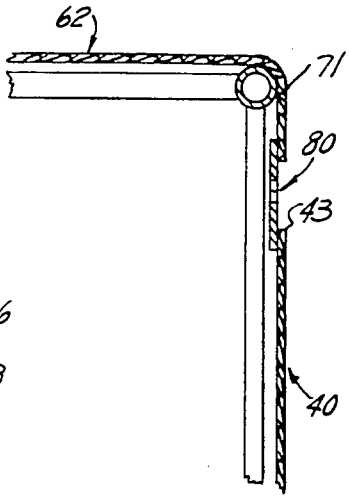
FIG. 10 is a view similar to FIG. 9 but showing a modification thereof.
Figure 11:
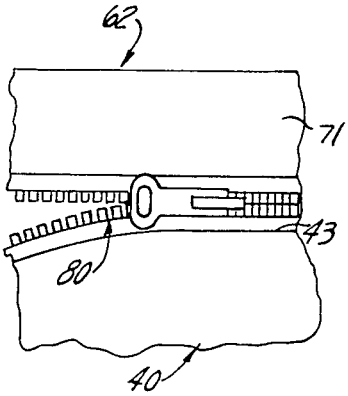
FIG. 11 is a side elevation view of the structure of FIG. 10.

In structures wherein the "Bimini"-type top 62 is made of canvas, the enclosure 40 may be attached to the edge by snaps, or by a marine zipper 80 as shown at FIGS. 10–11.

It will be appreciated by those skilled in the art that the enclosure 40 for an open area or open cockpit in a watercraft is simply attached to an elevated covering or top disposed over the open area or cockpit by any conventional attachment means permitting fast and easy attachment and removal, and that the enclosure of the invention requires no fastening means at its bottom edge which is simply weighted and preferably caused to engage by gravity a surface portion of the watercraft boat deck, the lower edge of the enclosure being held by gravity against the surface portion, irrespective of whether the surface portion is substantially horizontal, vertical, or at an angle.

It will also be appreicated by those skilled in the art that the enclosure material may be canvas, screening material or a thin film of transparent plastic material.

Having thus described the invention by way of examples of structure thereof, modifications thereof will be apparent to those skilled in the art, what is claimed as new is as follows:

I claim:

1. In a watercraft having an open area and an elevated covering disposed over said open area, the combination of said elevated covering and a free hanging flexible enclosure having an upper edge removably secured to said covering by manually operable fasteners, said flexible enclosure being draped downward from said elevated covering and having a lower edge formed as a gusset-like hem wrapped around a weighting member, said flexible enclosure being so dimensioned in height and said weighting member being of such weight that said weighting member holds said free hanging enclosure relatively taut and so that said gusset-like hem at the lower edge of said enclosure engages a surface of said watercraft wherein said weighting member comprises a rope.

2. The combination of claim 1 wherein said enclosure is made of a single length of material.

3. The combination of claim 2 wherein said weighting member is a length of rope.

4. The combination of claim 3 wherein said surface is a substantially vertical surface and said enclosure lower edge provided with said length of rope is laterally engaged with said surface.

5. The combination of claim 2 wherein said enclosure is made of canvas.

6. The combination of claim 2 wherein said enclosure is made of transparent plastic.

7. The combination of claim 2 wherein said enclosure is made of screening material.

8. The combination of claim 1 wherein said weighting member is a length of rope.

9. The combination of claim 8 wherein said surface is a substantially vertical surface and said enclosure lower edge provided with said length of rope is laterally engaged with said surface.

10. The combination of claim 1 wherein said enclosure is made of canvas.

11. The combination of claim 1 wherein said enclosure is made of transparent plastic.

12. The combination of claim 1 wherein said enclosure is made of screening material.

* * * * *